US007338325B2

(12) United States Patent
Yin et al.

(10) Patent No.: US 7,338,325 B2
(45) Date of Patent: Mar. 4, 2008

(54) ELECTRICAL ADAPTER

(75) Inventors: Hao Mai Yin, Kunsan (CN); Wei Ya Cheng, Kunsan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 212 days.

(21) Appl. No.: 11/028,104

(22) Filed: Dec. 31, 2004

(65) Prior Publication Data

US 2005/0277325 A1 Dec. 15, 2005

(30) Foreign Application Priority Data

Jun. 14, 2004 (CN) ..... 2004 2 0028017

(51) Int. Cl.
*H01R 25/00* (2006.01)

(52) U.S. Cl. ..... 439/638

(58) Field of Classification Search ..... 439/638, 439/639, 76.1

See application file for complete search history.

(56) References Cited

U.S. PATENT DOCUMENTS 4,728,163 A 3/1988 Kittinger et al.
5,123,859 A 6/1992 Davis et al.
5,290,178 A * 3/1994 Ma ..... 439/652
5,430,618 A 7/1995 Huang
5,716,228 A * 2/1998 Chen ..... 439/358
6,146,194 A * 11/2000 Lok ..... 439/541.5
2004/0048494 A1 3/2004 Yu
2004/0092139 A1 * 5/2004 Merz ..... 439/76.1

* cited by examiner

*Primary Examiner*—Briggitte Hammond
*Assistant Examiner*—Vanessa Girardi
(74) *Attorney, Agent, or Firm*—Wei Te Chung

(57) ABSTRACT

An electrical adapter (100) includes an insulative casing defining a receiving space therein. The receiving space has a first opening (30) opened to an exterior in a lengthwise direction and a second opening (451) opened to an exterior in a lateral direction wherein the lengthwise and lateral directions are perpendicular to each other. A first connector unit (1) occupies the first opening along the lengthwise direction and a second connector unit (2) occupies the second opening along the lateral direction and electrically connected with the first connector unit.

8 Claims, 6 Drawing Sheets

ELECTRICAL ADAPTER

BACKGROUND OF THE INVENTION

1. Field of the Invention

The present invention relates to an electrical adapter, and particularly to an electrical adapter for joining two electrical devices having different designs and configurations.

2. Description of the Prior Art

A computer mainframe and its periphery device are usually electrically connected together. However, the computer mainframe and its periphery devices have different interface standards and each has different numbers electrical contacts therein. Understandably, different interface standards with different electrical contacts cannot mate with each other directly. Many electrical adapters, thereby, are designed to electrically interconnect those different interface standard devices. U.S. Pat. Nos. 4,728,163, 5,123,859 and 5,430,618 respectively disclose such an electrical adapter. However, the electrical adapters defined in the prior arts involve such problems as each of the electrical adapters is provided with two different interfaces generally in a planar and right about relationship. The length of the electrical adapter prevents those different interface standard devices from being placed close to each other, thereby making surrounding area of the electrical adapter enlarged and potential impact inevitably increased. Especially when the electrical adapter is adapted for realizing electrically interconnection between a computer mainframe and a cable set, the cable set is susceptible to encounter impact from unexpected exterior sources, thereby stabilization of the electrically interconnection is not assured.

In addition, U.S. Publication Patent No. 2004/0048494 A1 discloses an electrical adapter with a foldable housing. The foldable housing includes a first housing part, a second housing part, and a pivot joint jointing the first and second housing parts and permitting relative rotation between the first and second housing parts about a pivot axis. However, the structure of the electrical adapter is relatively complex and the pivot joint is inclined to fatigue and accordingly the first and second housing parts cannot freely rotate to their normal positions after a period of use.

Hence, an improved electrical adapter is desired to overcome the disadvantages of the prior art.

BRIEF SUMMARY OF THE INVENTION

Therefore, a main object of the present invention is to provide an electrical adapter which provides a first opening and a second opening in a desired relationship so as to minimize the space occupied by the electrical adapter and realize stable interconnection between different interface standard devices.

To fulfill the above-mentioned objects, an electrical adapter according to the present invention includes an insulative casing defining a receiving space therein. The receiving space has a first opening opened to an exterior in a lengthwise direction and a second opening opened to an exterior in a lateral direction wherein the lengthwise and lateral directions are perpendicular to each other. A first connector unit occupies the first opening along the lengthwise direction and a second connector unit occupies the second opening along the lateral direction and electrically connected with the first connector unit.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
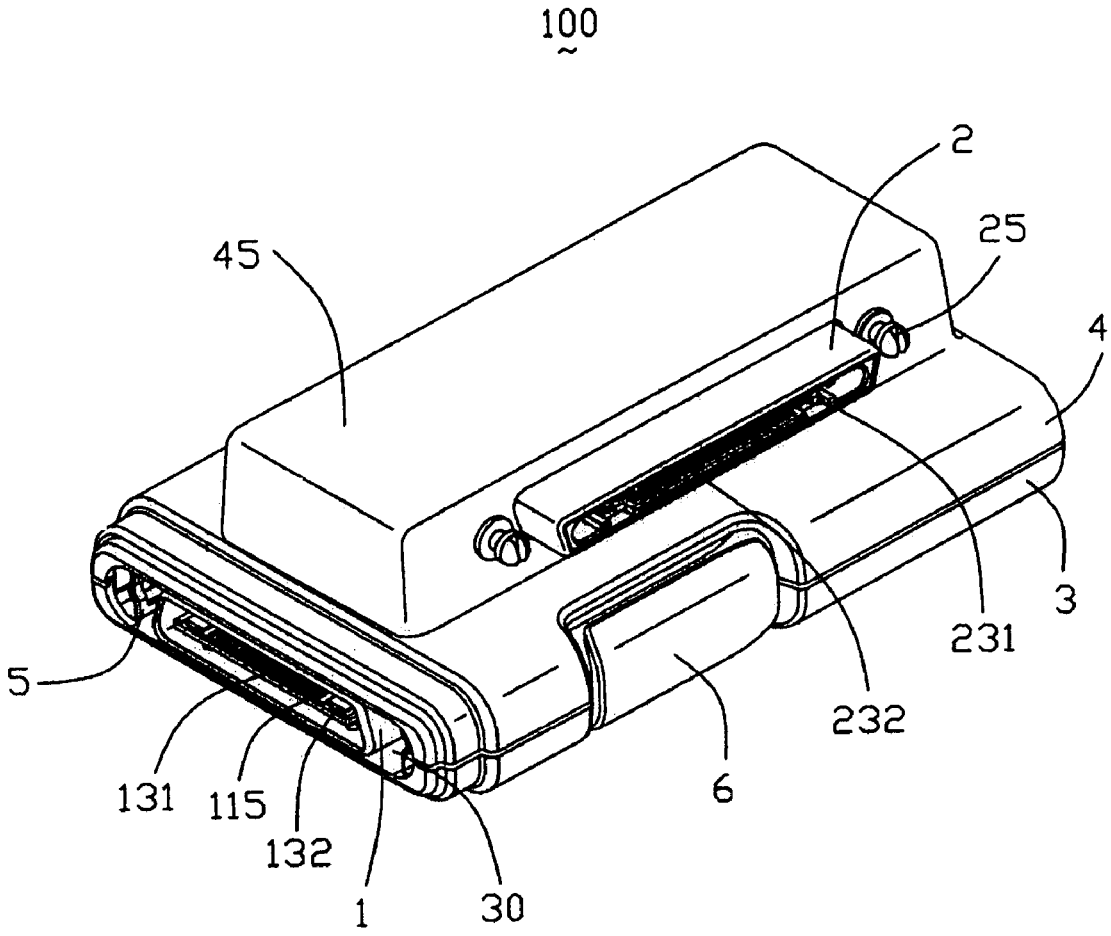
FIG. 1 is a perspective view of an electrical adapter according to the present invention.
Figure 6:
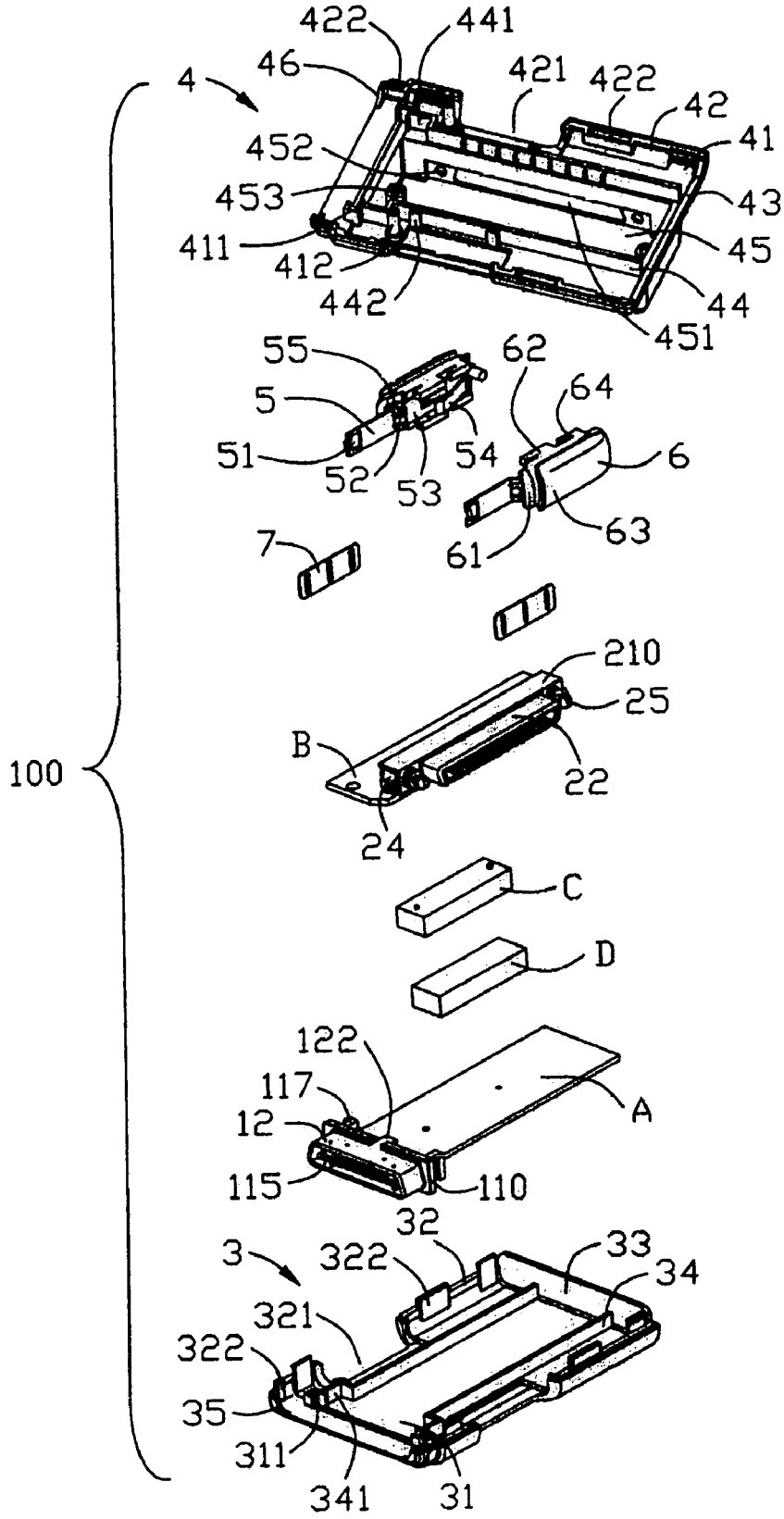
FIG. 6 is a partly, exploded view of the electrical adapter of FIG. 1.

Referring to the drawings in greater detail, and first to FIGS. 1 and 6, an electrical adapter 100 according to the present invention is adapted for realizing electrically connection between a Notebook and a docking station. The electrical adapter 100 comprises an insulative casing, a first connector unit 1, a second connector unit 2, a printed circuit board module and a pair of buttons. Further, the insulative casing is a rectangular contour and includes a lower half 3 and an upper half 4 engaged with each other which together define a receiving space (not labeled). The receiving space is provided with a first opening 30 occupied by the first connector unit 1 and a second opening 451 occupied by the second connector unit 2. The printed circuit board module includes a printed circuit board A electrically connected with the first connector unit 1, a printed circuit board B electrically connected with the second connector unit 2 and a pair of header C, D adapted for realizing electrically connection between the printed circuit board A and B. The detail description will be discussed hereinafter.

Figure 2:
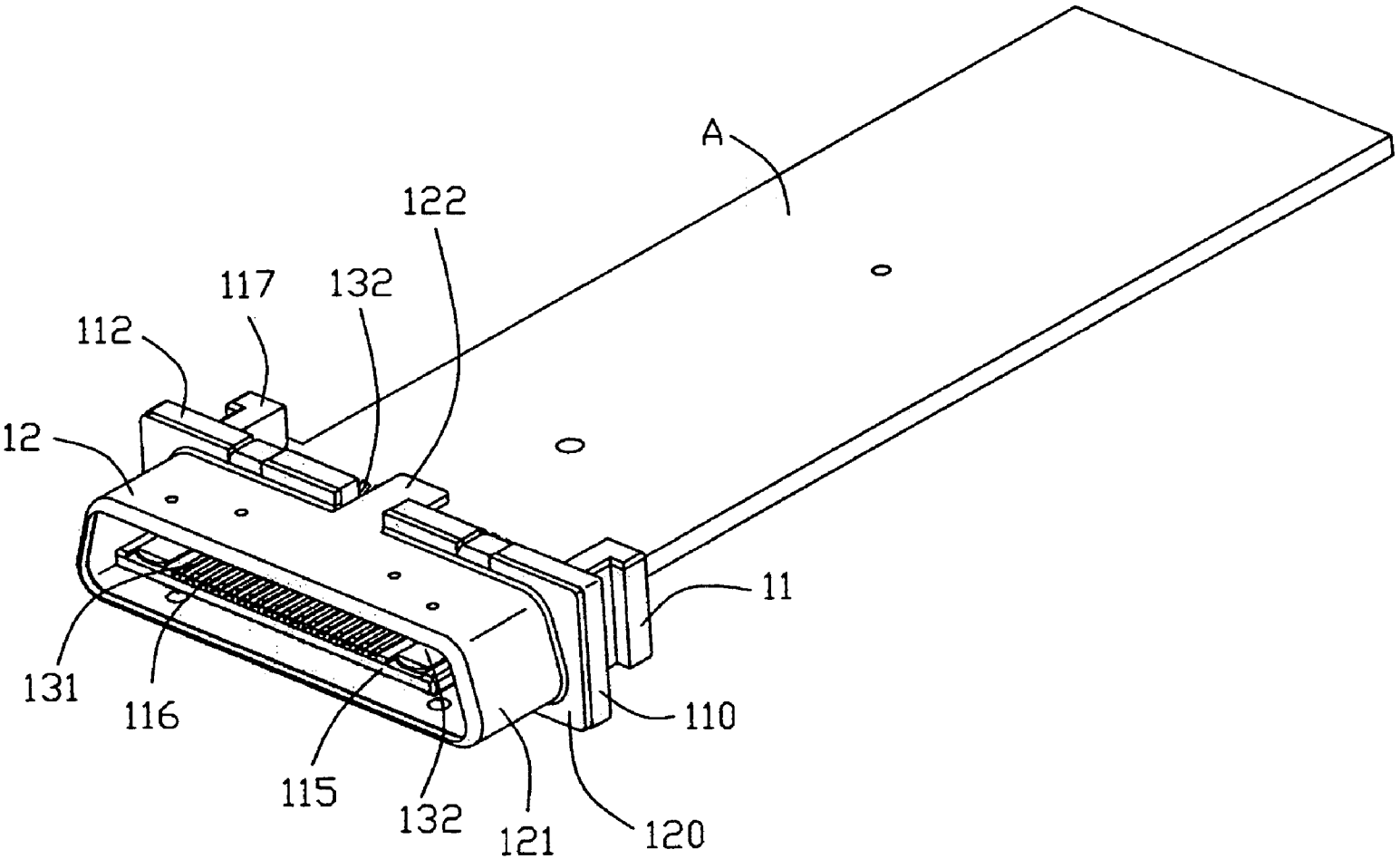
FIG. 2 is a perspective view of a first connector unit assembled with a printed circuit board A.
Figure 3:
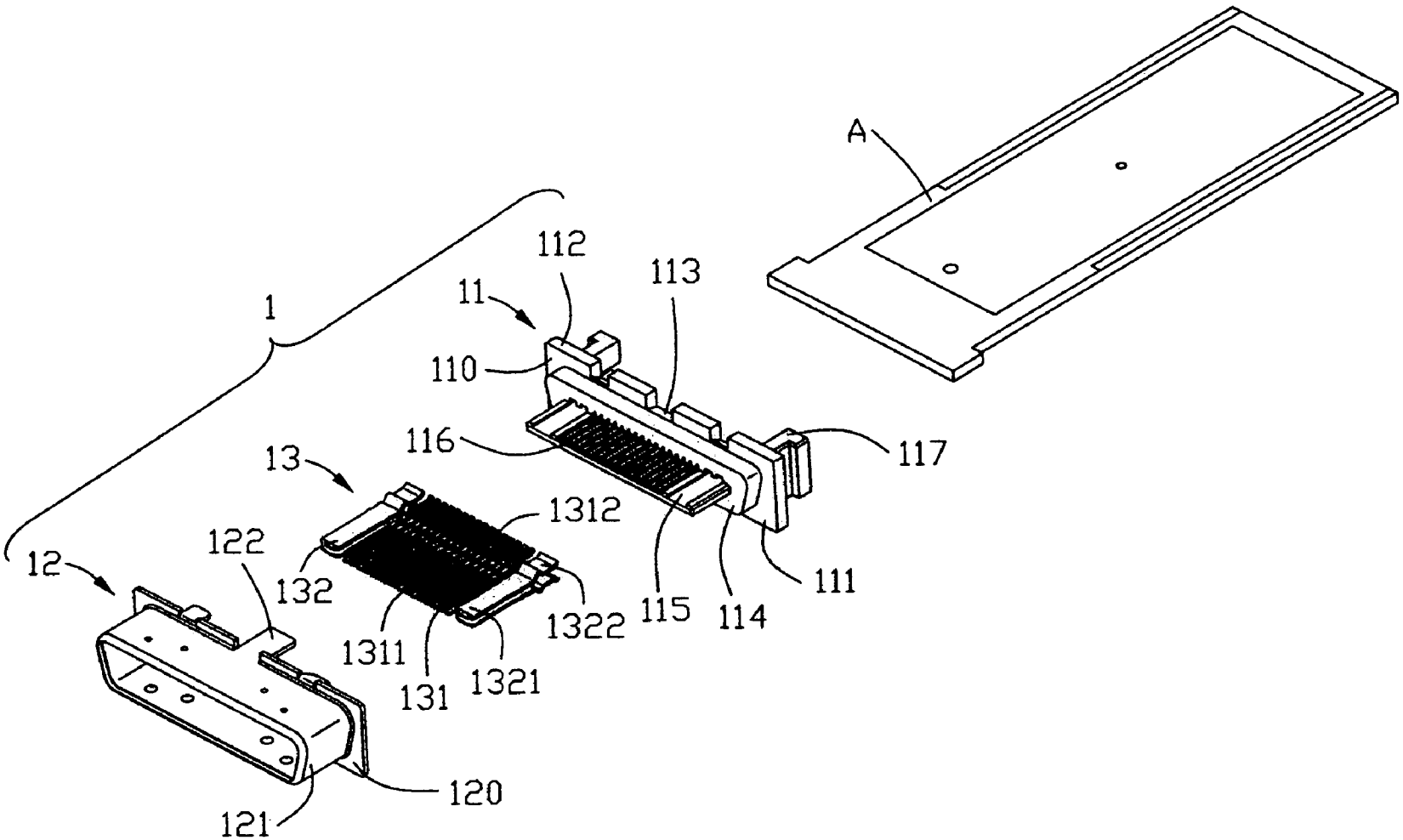
FIG. 3 is an exploded, perspective view of FIG. 2.

Referring to FIGS. 2 and 3, the first connector unit 1 includes a first insulative housing 11, a first metal shielding 12 and a first conductive terminal set 13. The first housing 11 has a longitudinal base 110 which defines a mating surface 111, a joint surface (not labeled) opposite to the mating surface 111, a top surface 112 interconnected with the mating surface 111 and the joint surface, and a bottom surface (not labeled) opposite to the upper surface 112. The upper surface 112 defines a recess 113 through the mating surface 111 and the joint surface. The mating surface 111 forms a generally D-shaped protrusion 114 forwardly extending from a middle region thereof, in sequence, a mating tongue 115 forwardly extends from a middle reign of the protrusion 114. A plurality of passageways 116 are defined extending from the mating tongue 115 to the base 110. A pair of spaced L-shaped arms 117 rearwardly and outwardly extend from opposite sides of the joint surface wherein a space between the arms 117 is equal to width of front edge of the print circuit board A. The shielding 12 is affixed to the housing 11 and includes a flat plate 120 covering the mating surface 111, a mating frame 121 forwardly extending from the flat plate 120 to enclose the protrusion 114 and the mating tongue 115, and a tail plate 122 rearwardly extending from top surface of the mating frame 121 corresponding to the recess 113 for engagement therewith. The first terminal set 13 is arranged in upper and lower rows to be received in corresponding passageways 116 of the mating tongue 115 and includes a plurality of signal terminals 131 spaced from each other at middle reign thereof for signal transmission and a plurality of power terminals 132 distributed at outmost thereof for power transmission, wherein there are two pairs of the power terminals 132 and the power terminals 132 have larger width than the signal terminals 131 in accordance with the preferred embodiment of the present invention. Each of the first terminal set 13 is generally straight in shape and has a contacting portion 1311, 1321 adapted for electrically connection with a corresponding contact of a mating connector (not shown) and a tail portion 1312, 1322 adapted for electrically connection with the printed circuit board A by known process such as soldering etc.

Figure 4:
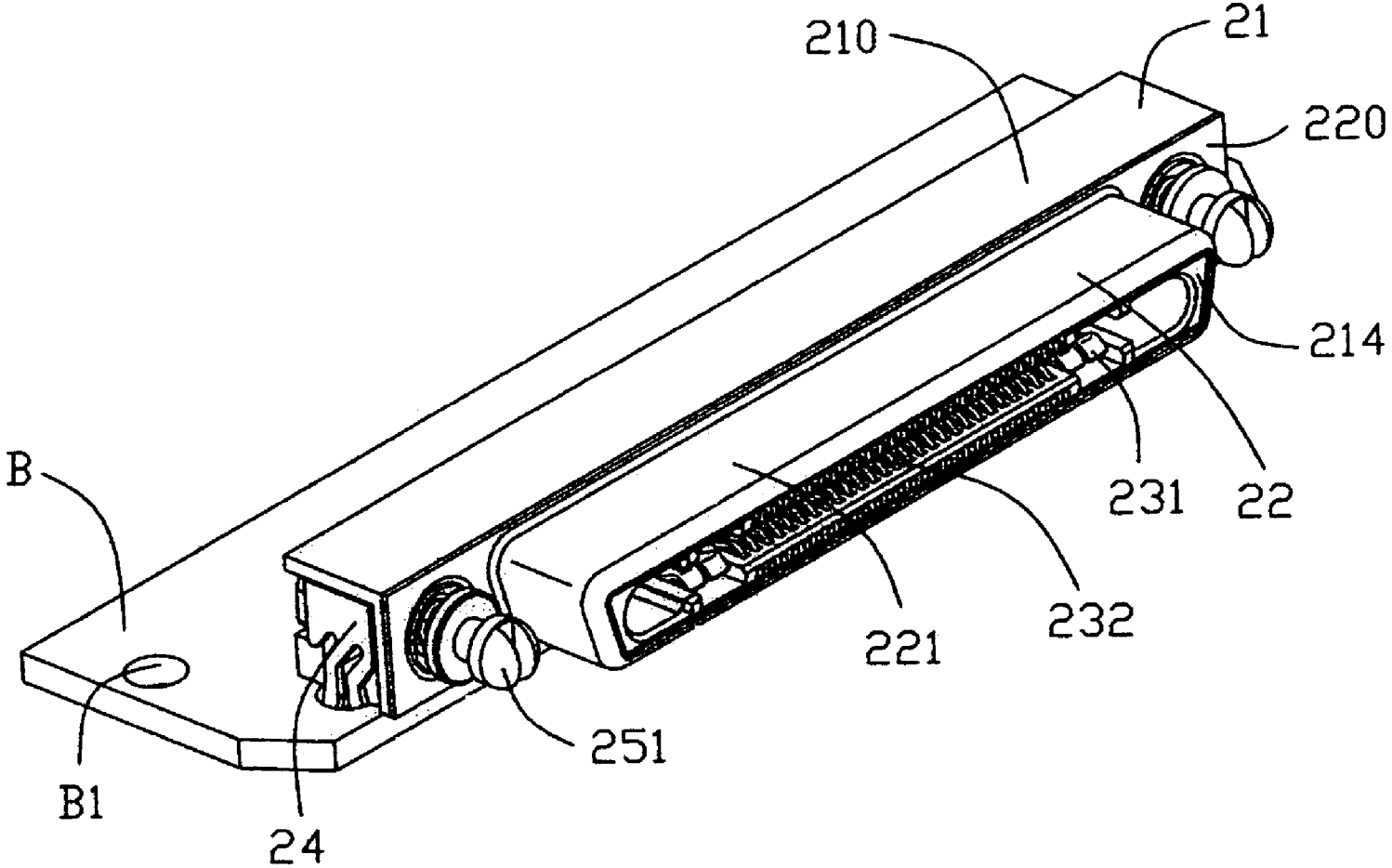
FIG. 4 is a perspective view of a second connector unit assembled with a printed circuit board B.
Figure 5:
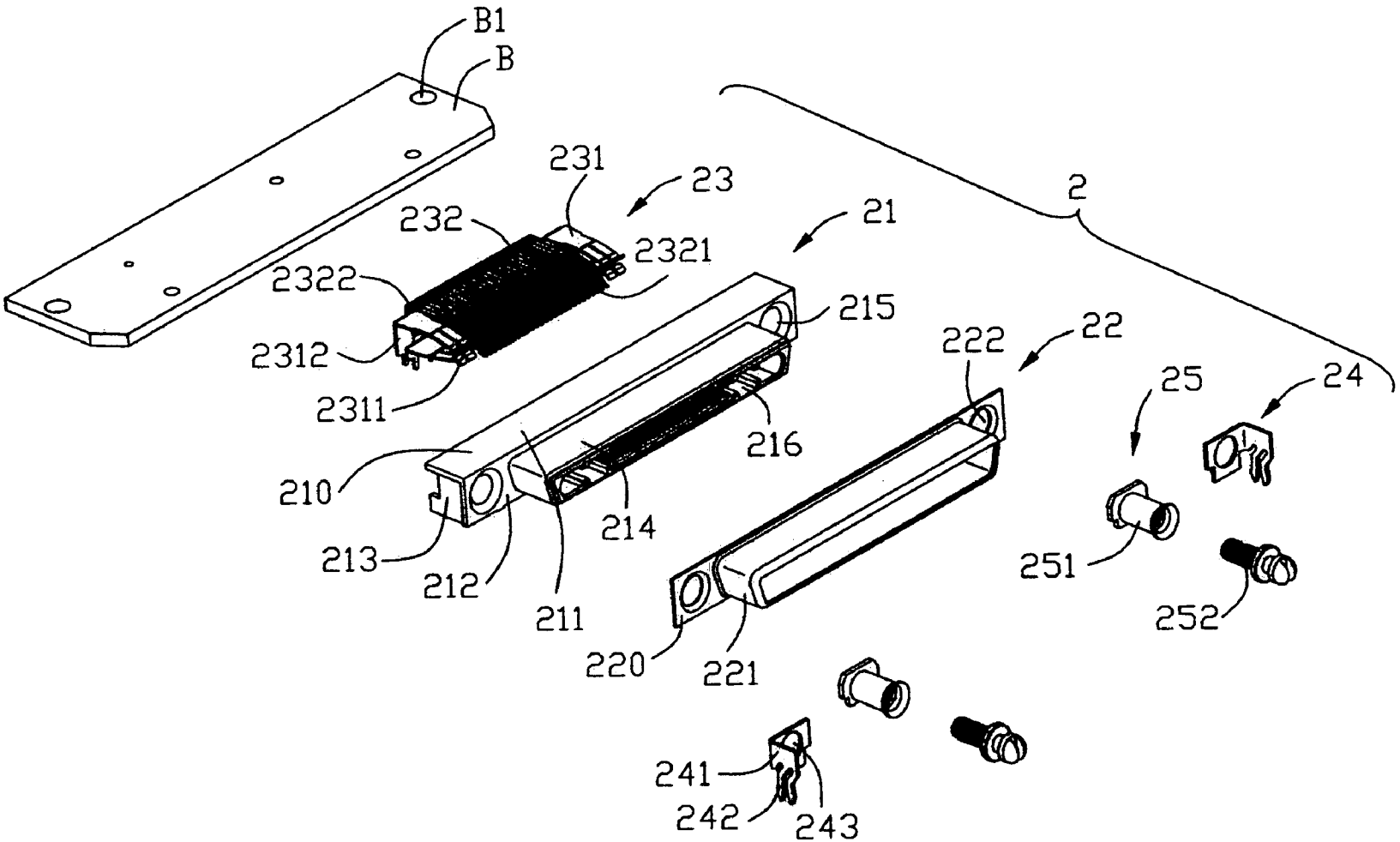
FIG. 5 is an exploded view of FIG. 4.

Referring to FIGS. 4 and 5, the second connector unit 2 includes a second insulative housing 21, a second metal shielding 22, a second conductive terminal set 23, a pair of plate cushions 24 and a pair of fastening members 25. The second housing 21 has a longitudinal body 210 defining an upper surface 211, a mounting surface (not labeled) opposite to the upper surface 211 adapted for being attached to the printed circuit board B, a front surface 212, a rear surface and a pair of side surfaces 213. A D-shaped nose portion 214 forwardly extends from middle reign of the front surface 212 and defines a plurality of grooves 216 at upper and lower inner walls thereof for receiving the second terminal set 23 therein. A pair of body holes 215 spaced by the nose portion 214 are defined adjacent to opposite side surfaces 213 and respectively extend through the front surface 212 and the rear surface. The second shielding 22 is affixed to the second housing 21 and includes a blade plate 220 covering the front surface 212 of the housing 21, a mating skeleton 221 forwardly extending from the blade plate 220 to enclose the nose portion 214, and a pair of blade holes 222 corresponding to the body holes 215 for uniformities therewith. The second terminal set 23 is arranged in upper and lower rows to be received in the grooves 216 and includes a plurality of signal terminals 231 spaced from each other at middle reign thereof and a plurality of power terminals 232 distributed at outmost thereof. Each of the second terminal set 23 is generally L-shaped and has a mating portion 2311, 2321 adapted for electrically connection with a corresponding cable of a mating cable set (not shown) and a solder portion 2312, 2322 adapted for electrically connection with the printed circuit board B. The plate cushions 24 locate at opposite lateral sides of the base 210 and respectively have a right-angle portion 241 aligned with edges of intersected side surfaces 213 and rear surface, a pair of tags 242 downwardly extending from the right-angle portion 241 and a cushion hole 243 corresponding to the body hole 215 and the blade hole 222. The fastening members 25 are respectively assembled to opposite sides of the second connector unit 2 and include a cylindrical tube 251 defining a screw hole therein and a bolt 252 adapted for screwing into the screw hole.

Referring to FIG. 6, the lower and upper halves 3 and 4 are formed by die casting metallic material and respectively have a main wall 31, 41, a pair of side walls 32, 42 extending from opposite sides of the main wall 31, 41, a front end 35, 46, and a rear end 33, 43 opposite to the front end 35, 46. The main walls 31, 41 respectively protrude a pair of shoulder portions 311, 411 adjacent to the front end 35, 46 for commonly securing the base 110 of the first connector unit 1, and a pair of elongated partitions 34, 44 along the side walls 32, 42 for commonly securing the printed circuit board A in position. The partitions 34, 44 extend from the rear ends 33, 43 toward the shoulder portions 311, 411 and each having a stepped mounting edge 341, 441 at front edge thereof for abutting against the arm 117 of the first connector unit 1. The lower and upper halves 3, 4 respectively define a pair of notches 321, 421 at opposite side walls 32, 42 for being assembled with the buttons. A plurality of upwardly slices 322 extend beyond the side walls 32 of the lower half 3, and a plurality of slots 422 are defined along the side walls 42 of the upper half 4 corresponding to the configuration of the slices 322 such that the slices 322 are received in the slots 422 to joint the lower and upper halves 3, 4 together. Furthermore, the upper half 4 form two pairs of protrusions 442 in lengthwise direction along outside of corresponding partitions 44 and a pair of dowel posts 412 in lateral direction near the stepped mounting edges 441 of the partitions 44, wherein a distance between the pair of protrusions 442 in lengthwise direction is generally equal to length of corresponding notch 421. In addition, the upper half 4 forms a generally rectangular hollow bulge portion 45 located in reign between the partitions 34, 44 and the bulge portion 45 defines the second opening 451 at one of elongated sides thereof. A pair of bulge holes 452 are defined in align with the body hole 215 of the second connector unit 2 and spaced by the second opening 451. When the second connector unit 2 is affixed to the upper half 4, the tubes 251 of the fastening member 25 extend through the cushion holes 243, the body holes 215, the blade hole 222 and the bulge holes 452 in turn, and the bolt 252 screw in corresponding screw holes adapted to tie together. Furthermore, a pair of supporting posts 453 forms along lengthwise direction and extends from inner surface of the bulge portion 45 for supporting the printed circuit board B in position, wherein the printed circuit board B defines a pair of supporting holes B1 corresponding to the supporting post 453.

The buttons are assembled to the notches 321, 421 of the lower and upper halves 3, 4 and each includes a latch member 5, a press member 6 and an enforcement plate 7. The latch member 5 is an elongated metal plate and includes a hook portion 51 at one end thereof for engagement with appropriate latch means of the complementary mating connector, a retention portion 52 defining a dowel slot 55 corresponding to the dowel post 412 of the upper half 4, a driving portion 53 actuated by the press member 6 and a resilient portion 54 obliquely and forwardly extending from the driving portion 53. The press member 6 includes a main portion 61 having a configuration for mating with the notches 321, 421, a plurality of flanges 62 extending from opposite sides of the main portion 61, a plurality of wedged slits 64 defined adjacent to the flanges 62 to interferentially fit with the fixing portion 53 of the latch member 5, and an operating portion 63 coving the main portion 61 to define a generally cartouche shaped surface for engagement by an operator's thumb or finger. The enforcement plates 7 are inserted into gaps defined between the lengthwise protrusions 442 and the partitions 44, wherein the length of the enforcement plate 7 is generally equal to the distance between the lengthwise protrusions 442. When the buttons are assembled in position, the pressing member 6 are exposed out of the notches 321, 421 and the latch member 5 extending into the first opening 30 along inner side of the casing. It can be seen that the resilient arms 54 of the latch member 5 respectively bias against the enforcement plate 7. When electrical connector unit 1 mates/unmates the mating connector, the operating portions 63 are pressed and the main portions 61 inwardly deflect the driving portions 53, thereby rendering the hook portion 51 to enter into/withdraw from the mating connector and allowing the mating/unmating occurs.

From the above description, it can be seen that the first opening 30 is formed at front ends 35,46 of the upper and lower halves 3, 4 and the second opening 451 is defined at one sides of the bulge portion 45. The first opening 30 is opened to an exterior in the lengthwise direction and the second opening 451 opened to an exterior in the lateral direction. In the preferred embodiment, the first connector unit 1 is a plug and occupies the first opening along the lengthwise direction for electrically connection with a Notebook and the second connector unit 2 is a jack and occupies the second opening 451 along the lateral direction for electrically connection with a docking station. It should be noted that since the first opening 30 and the second opening 451 are generally perpendicular to each other and in different levels such that the first connector unit 1 and the second connector unit 2 are generally in a crossed manner. The length of the electrical adapter 100 is greatly reduced and renders the docking station close to the Notebook, thereby decreasing the possibility of encountering impact from unexpected exterior sources and ensuring the electrically interconnection therebetween.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

an insulative casing having a rectangular contour defining lengthwise and lateral directions perpendicular to each other, with a height extending in a vertical direction perpendicular to both the lengthwise and lateral directions;

a receiving space defined in a position of a periphery of the rectangular contour of the casing, and having a first opening opened to an exterior in the lengthwise direction and a second opening opened to an exterior in the lateral direction;

a first connector unit occupying the first opening along the lengthwise direction; and a second connector unit occupying the second opening along the lateral direction and electrically connected with the first connector unit; wherein the electrical adapter further comprises a printed circuit board module which establishes an electrical connection between the first connector unit and the second connector unit; wherein the printed circuit board module includes a first printed circuit board electrically connected with the first connector unit, a second printed circuit board electrically connected with the second connector unit, and a plurality of electrical components which establishes an electrical connection between the first printed circuit board and the second printed circuit board.

2. The electrical adapter as described in claim 1, wherein the casing includes an upper half and a lower half engaged with each other to define the receiving space therebetween.

3. The electrical adapter as claimed in claim 2, wherein the upper half has a bulge portion along the vertical direction.

4. The electrical adapter as claimed in claim 3, wherein the first opening is defined at front ends of the upper and lower halves and the second opening is defined at one of sides of the bulge portion.

5. The electrical adapter as claimed in claim 2, wherein the upper half and the lower half respectively define a pair of notches at opposite sides thereof, and wherein the electrical adapter further comprises a pair of buttons received in the notches, respectively.

6. The electrical adapter as described in claim 5, wherein each button includes a press member located at out side of the casing and a latch member assembled to the press member and extending into the first opening along inner side of the casing.

7. The electrical adapter as claimed in claim 1, wherein the first connector unit includes a first housing, a mating tongue extending from front edge of the first housing, a first terminal set embedded in the mating tongue and a first shielding enclosing the first housing and the tongue plate.

8. The electrical adapter as claimed in claim 1, wherein the second connector unit includes a second housing with a second terminal set embedded therein and a second shielding enclosing the second housing.

* * * * *